US008511011B2

(12) United States Patent
Emanuel

(10) Patent No.: US 8,511,011 B2
(45) Date of Patent: Aug. 20, 2013

(54) STRUCTURAL FRAME MEMBER HAVING A CAPPED CORNER KEY PASSAGE

(75) Inventor: Brian A. Emanuel, Baraboo, WI (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 13/604,037

(22) Filed: Sep. 5, 2012

(65) Prior Publication Data

US 2013/0111846 A1 May 9, 2013

Related U.S. Application Data

(60) Provisional application No. 61/555,384, filed on Nov. 3, 2011, provisional application No. 61/558,919, filed on Nov. 11, 2011.

(51) Int. Cl.
*E06B 1/04* (2006.01)

(52) U.S. Cl.
USPC ..... 52/204.1; 52/204.5

(58) Field of Classification Search
USPC ..... 52/656.9, 202, 204.1, 204.5, 204.54
See application file for complete search history.

(56) References Cited

U.S. PATENT DOCUMENTS

| | | | | |
|---|---|---|---|---|
| 3,429,602 | A * | 2/1969 | Dirilgen | 403/295 |
| 4,164,105 | A * | 8/1979 | Herbst et al. | 52/202 |
| 4,831,804 | A * | 5/1989 | Sayer | 52/475.1 |
| 5,187,886 | A * | 2/1993 | Wu et al. | 40/759 |
| 7,174,691 | B2 * | 2/2007 | de Garay Arellano | 52/716.1 |
| 7,677,003 | B2 * | 3/2010 | Baughn et al. | 52/473 |
| 2005/0210777 | A1 * | 9/2005 | Baughn et al. | 52/202 |

* cited by examiner

*Primary Examiner* — Basil Katcheves
(74) *Attorney, Agent, or Firm* — Boyle Fredrickson, S.C.

(57) ABSTRACT

A structural frame member, such as for constructing a window frame, includes a body portion having a first section defining a number of axially extending passages and a second section defining a key passage area. A cap portion is engaged with the key passage area to define an enclosed key passage. The key passage area may be defined by a pair of protrusions that extend from a wall on the body portion, and the cap portion is engaged with the pair of protrusions. The cap portion and the protrusions may include snap-type engagement structure that secures the cap portion to the pair of protrusions. The enclosed key passage may extend across a majority of the depth of the body portion. A frame assembly formed of at least a pair of structural frame members, and a method of assembling a frame member, are also disclosed.

18 Claims, 8 Drawing Sheets

STRUCTURAL FRAME MEMBER HAVING A CAPPED CORNER KEY PASSAGE

CROSS REFERENCE TO RELATED APPLICATIONS

This application claims the benefit of U.S. provisional patent application Ser. No. 61/555,384 filed Nov. 3, 2011 and U.S. provisional patent application Ser. No. 61/558,919 filed Nov. 11, 2011, the entire contents of which are hereby expressly incorporated by reference.

BACKGROUND AND SUMMARY

This invention relates generally to a structural frame member, and more particularly to a structural frame member that can be joined together with other frame members to form a frame assembly.

Frame members, such as window frame members, are commonly formed with a key passage that is adapted to receive a corner key used to secure adjacent frame members together. Typically, the key passage is in the form of an enclosed passage located within an inner area of the frame member. The key passage is defined by a series of walls, which are typically integrally formed with each other and with the remaining structure of the frame member, such as in an extrusion or pultrusion process. The present invention seeks to improve upon such prior art by providing a key passage defined by a series of walls that are not integrally formed with each other.

In accordance one aspect of the present invention, a structural frame member includes a body portion having a first section defining a number of axially extending passages and a second section defining a key passage area. A cap portion is configured for engagement with the key passage area. The cap portion and the key passage area of the body portion cooperate to define an enclosed key passage. The key passage area of the body portion may be defined by a pair of spaced apart protrusions that extend from a wall forming a part of the body portion, and the cap portion is configured for engagement with the pair of spaced apart protrusions. In one form, the cap portion and the pair of spaced apart protrusions include snap-type engagement structure that secures the cap portion to the pair of spaced apart protrusions upon application of a transversely directed force to the cap portion. Representatively, the first section of the body portion may be an outer section and the second section of the body portion may be an inner section, with the outer and inner sections being separated at least in part by the wall from which the spaced apart protrusions extend. In one embodiment, the body portion defines a depth, and the enclosed key passage defined by the key passage area of the body portion and the cap portion extends across a majority of the depth of the body portion.

The invention also contemplates a frame assembly formed of at least a pair of structural frame members and a method of assembling a structural frame member, substantially in accordance with the foregoing summary.

Various other features, aspects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF PARTICULAR EMBODIMENTS

The systems and methods described herein related generally to joining frame members together to form frame assemblies using corner keys which fit inside of the ends of the frame members. More particularly, the systems and methods relate to use of frame members having uniform cross-sections such as those formed by pultrusion or extrusion.

In some embodiments, the frame assembly described herein provides a high level of thermal insulation by virtue of having two or three or sometimes four enclosed longitudinal cavities defined within each frame member. In one embodiment, the frame assembly includes one or more corner keys which are positioned adjacent to an outer perimeter of the assembled frame. In some embodiments, the frame member configuration permits insertion of the corner keys without any milling, that is, without removing any material from the interior of the frame member. In one embodiment, a corner key cavity extends across at least 60% of a depth of a frame member.

In some embodiments, the frame assembly system includes a cavity for a corner key that is defined between a lineal member and a cap. In some embodiments, this corner key cavity is located adjacent to an outer perimeter of the assembled frame. This position of the corner key improves the strength and design pressure of the assembled frame.

In the FIGS., various embodiments are illustrated. Like numbers refer, where appropriate, to like parts throughout the several views.

Figure 1:
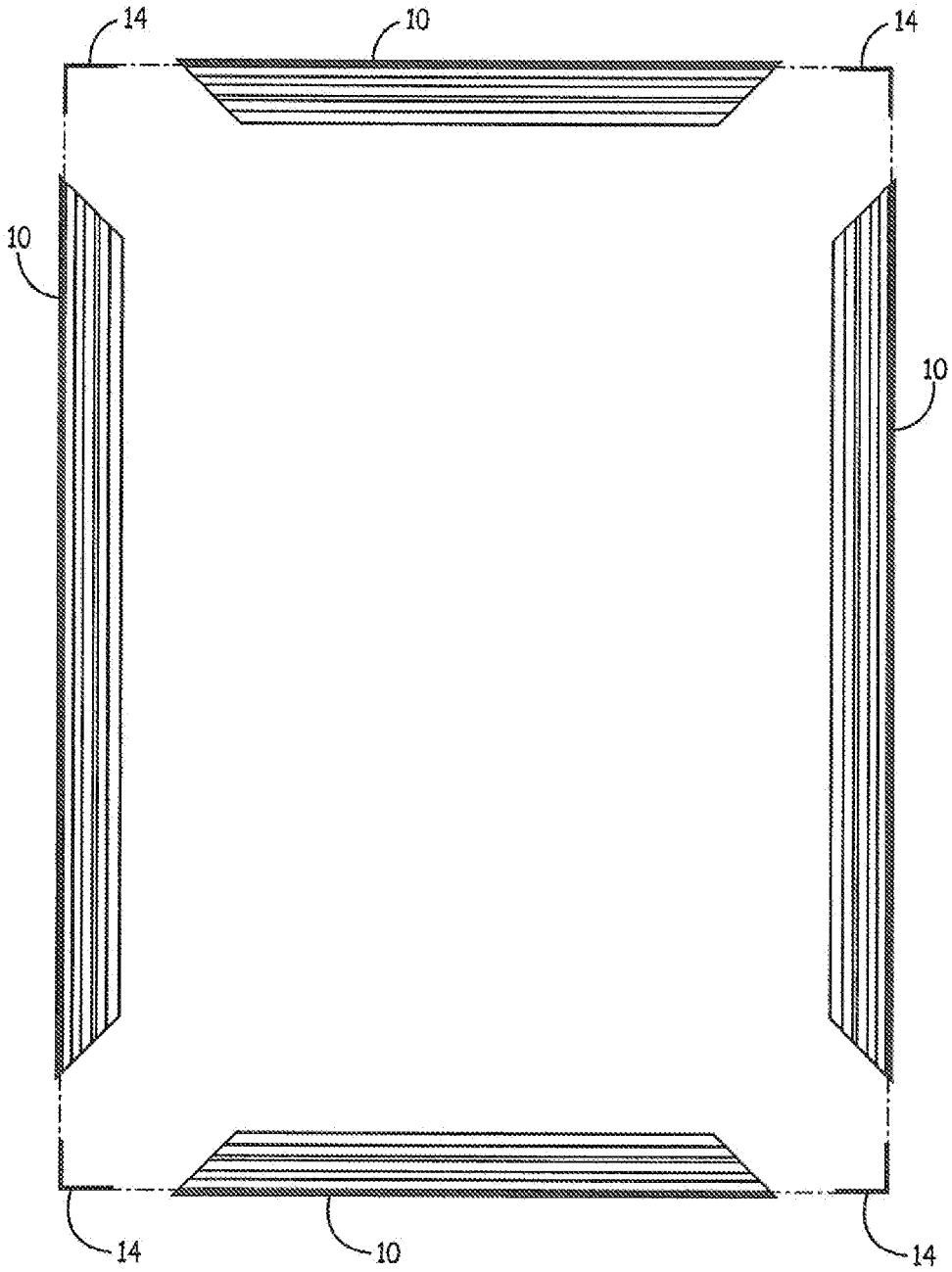
FIG. 1 depicts a front, partial exploded view of one embodiment of a frame assembly system.
Figure 2:
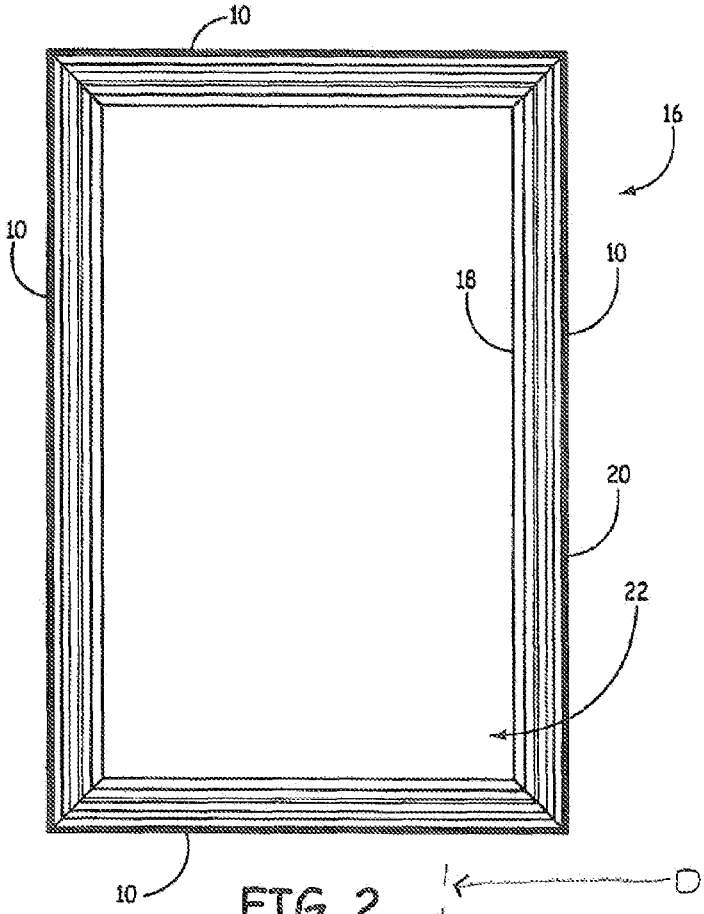
FIG. 2 depicts an assembled frame.

Now referring to FIG. 1, an exploded view of a frame assembly is illustrated including four frame members 10 and four corner keys 14. FIG. 2 shows an assembled frame 16 including the four frame members 10. The corner keys are not visible in FIG. 2 because each corner key 14 fits within the interior cavities of two adjacent frame members 10 to form a corner joint. The frame 16 defines an inner perimeter 18 and an outer perimeter 20. The opening 22 defined by the frame's inner perimeter 18 may be configured to mate with a window sash. The sash or the opening 22 may hold a pane of glass, an insulating glass unit, other transparent or translucent material, or a sheet.

The concepts related to frame members and assembly methods described herein are sometimes described in the context of windows. However, the same concepts apply to joining other structural or architectural elements at a corner joint. Many of the embodiments described herein have four frame members forming a frame assembly. However, it is also possible to apply the concepts described herein to an assembly that has two frame members, three frame members, five frame members, six frame members, and other numbers of frame members. Where a frame assembly does not from a closed perimeter, such as where there are two frame linear members at right angles to each other, the inner perimeter can be defined on the side of the frame assembly that has an angle between the frame members of less than 180 degrees. The outer perimeter can be defined on the side of the frame assembly that has an angle between frame members of greater than 180 degrees.

The frames of FIGS. 1-2 are rectangular frames. However, it is also possible to apply the frame assembly concepts described herein to non-rectangular frames, such as trapezoidal window frames, half-circle window frames, and other window frames, as will be discussed further herein.

Now referring to FIG. 1, corner keys 14 are configured with legs that extend into and fit within the hollow profiles of the frame members 10 to join the ends of the frame members 10 together. Adhesives can then be injected into the corners through specially designed passages to bond the corner keys 14 within the frame members 10 and thereby to secure the ends of the frame members 10 permanently together. In one embodiment, the adhesive is a two-part adhesive. The adhesive is selected to be compatible with the material of the frame member 10 and the material of the corner key 14. One example of a two-part adhesive is NovaGard 900-200 Corner Key Bonding Adhesive, available from NovaGard Solutions, Cleveland, Ohio, which is compatible with the resins in a fiberglass frame member 10 and compatible with a corner key 14 made of acrylonitrile-butadiene-styrene (ABS). In one embodiment, the adhesive when cured forms a polymer. In one embodiment, a hot melt adhesive is injected at the corners. In one embodiment, a thermoplastic adhesive is injected at the corners.

Figure 3:
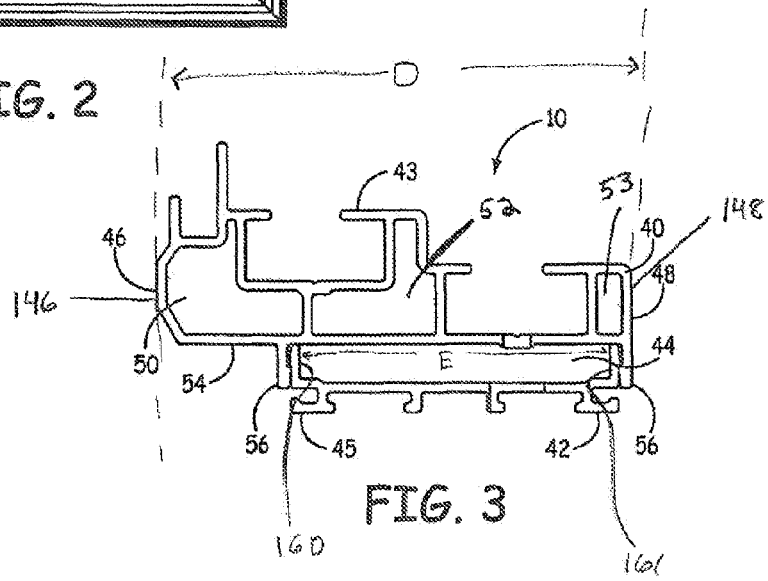
FIG. 3 depicts a cross-sectional view of a frame member for a double-hung window frame which is a component of the frame assembly of FIGS. 1 and 2, consistent with the technology disclosed herein, where the frame member includes a lineal member and a cap.
Figure 4:
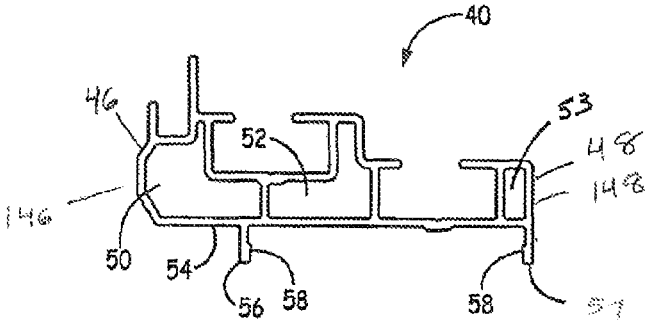
FIG. 4 depicts a cross-sectional view of the lineal member of FIG. 3.
Figure 5:
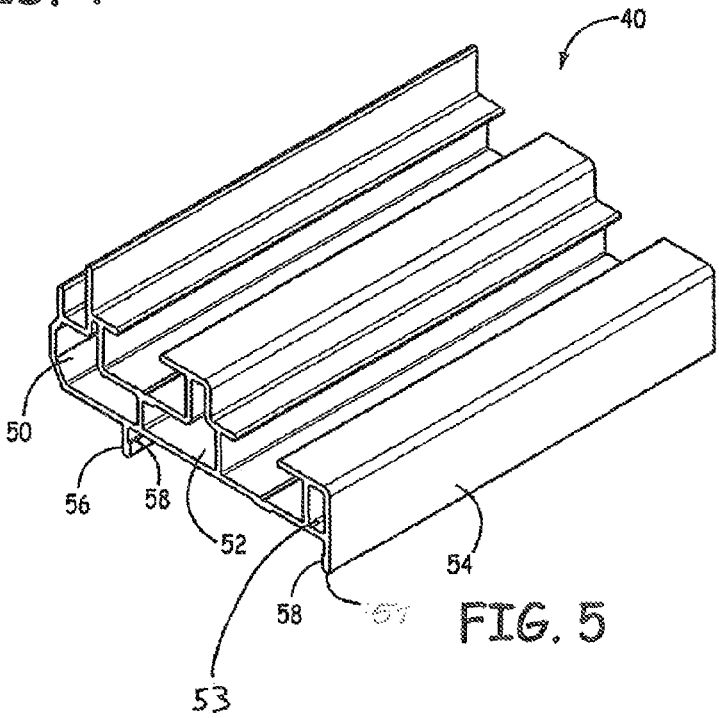
FIG. 5 depicts a perspective view of the lineal member of FIGS. 3-4.
Figure 6:
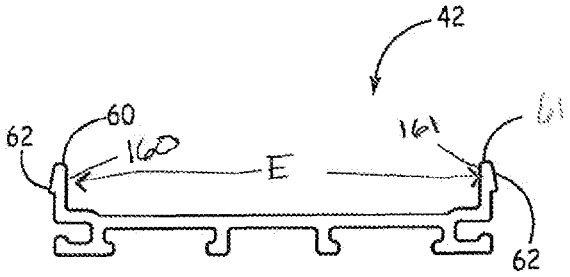
FIG. 6 depicts a cross-sectional view of the cap of FIG. 3.
Figure 7:
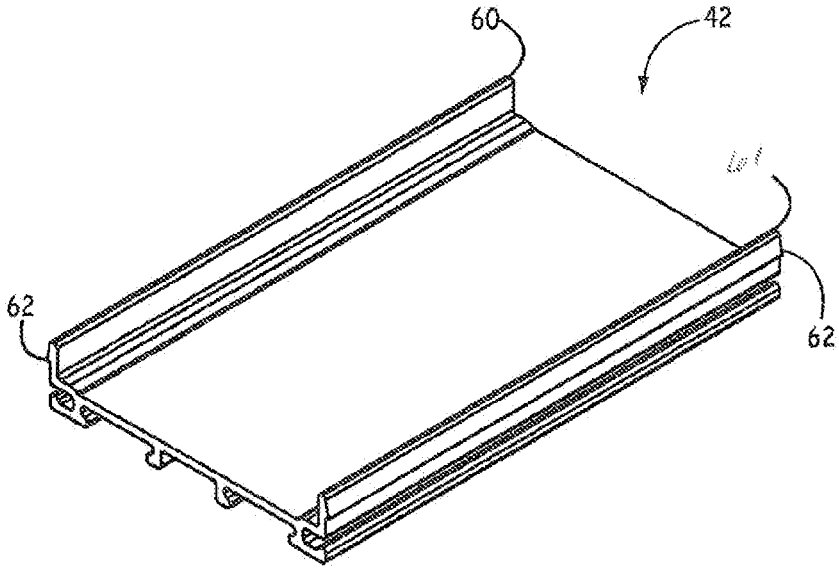
FIG. 7 depicts a perspective view of the cap of FIGS. 3 and 6.

Now referring to FIG. 3, a cross-sectional view of a frame member 10 is illustrated. The frame member 10 includes two components: a lineal member 40 and a cap 42. The lineal member 40 is also illustrated in FIGS. 4 and 5. The cap 42 is also illustrated in FIGS. 6 and 7.

Referring to FIG. 3, the cap 42 attaches to the lineal member 40 by a snap-fit attachment. A cavity 44 is formed by the attachment of the cap 42 to the lineal member 40. The cavity 44 is configured to receive one leg of the corner key 14 and is referred to as the corner key cavity 44. An inner first side 43 of the frame member 10 will define the inner perimeter 18 in the assembled frame 16, while the opposite outer second side 45 of the frame member 10 will define the outer perimeter 20 in the assembled frame 16 (See FIG. 2). The corner key cavity 44 is adjacent to the outer first side 45 of the frame member 10 that will define the outer perimeter 20 of the frame. This position increases the strength of the assembled frame compared to other positions of the corner key 14.

The corner key cavity 44 is a longitudinal cavity that extends along the entire length of the frame member 10. The corner key cavity 44 is bounded by a closed perimeter. The presence of this bounded cavity improves the insulation value of the frame member 10.

Figure 8:
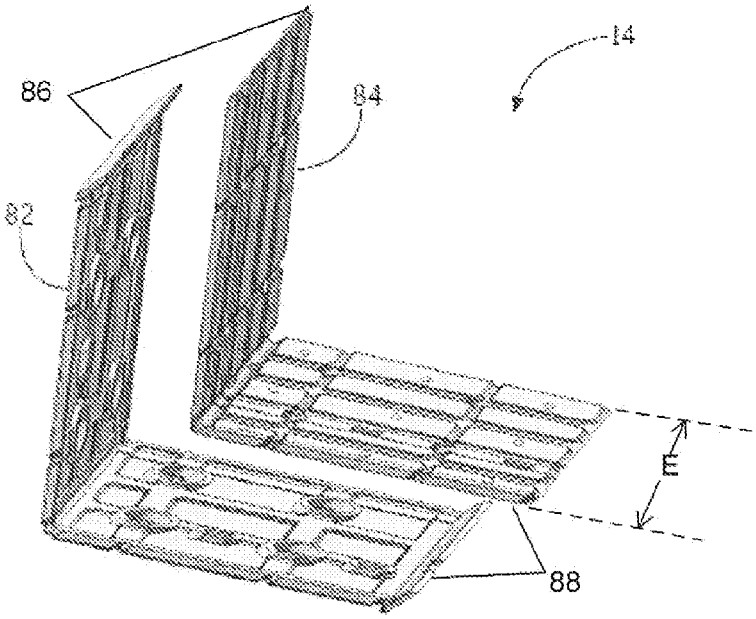
FIG. 8 is a perspective, exploded view of a corner key, including two parts.

In some embodiments, the corner key cavity 44 extends across most of the depth dimension of the frame member, thereby further increasing the strength of the assembled frame 16. The depth dimension D of the frame member 10 is measured from an outside surface 146 of an outer first side 46 to an outside surface 148 of an opposite inner second side 48 of the frame member 10. The depth extension E of the corner key 14 is measured across each of the legs 86, 88 of the corner key 14 as shown in FIG. 8. The corner key 14 fits snugly into the corner key cavity 44. As a result, another way to measure the depth extension E of the corner key 14 is by measuring the inside dimension of the corner key cavity 44. As shown in FIG. 6, the depth extension E of the corner key 14 can also be measured from an inside surface 160 of a first protrusion 60 to an inside surface 161 of a second protrusion 61.

Figure 10:
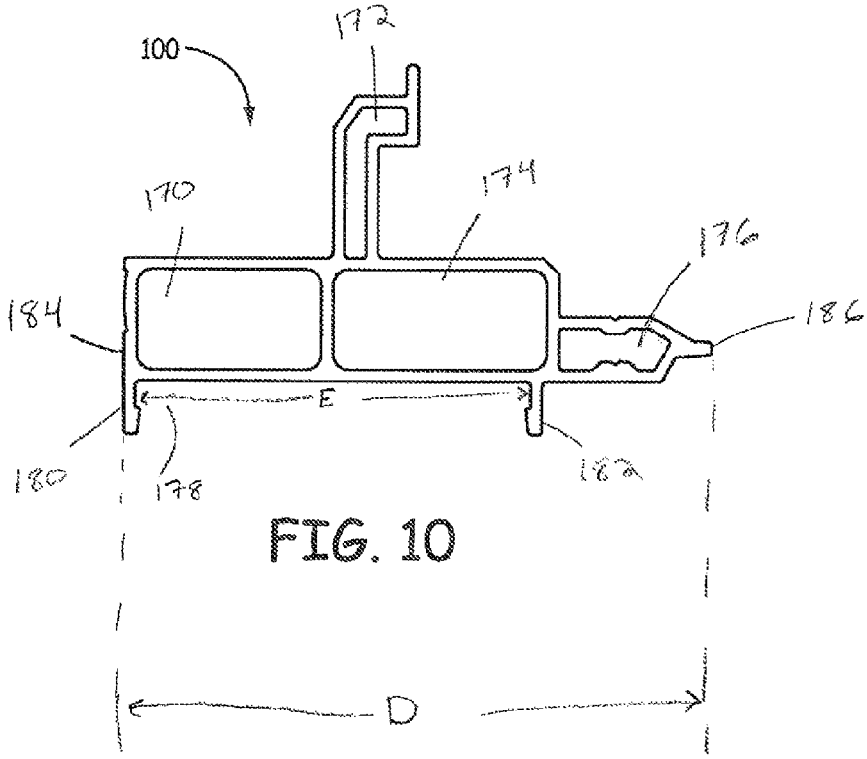
FIG. 10 depicts a cross-sectional view of a different lineal member for a use in a frame of a casement window.
Figure 11:
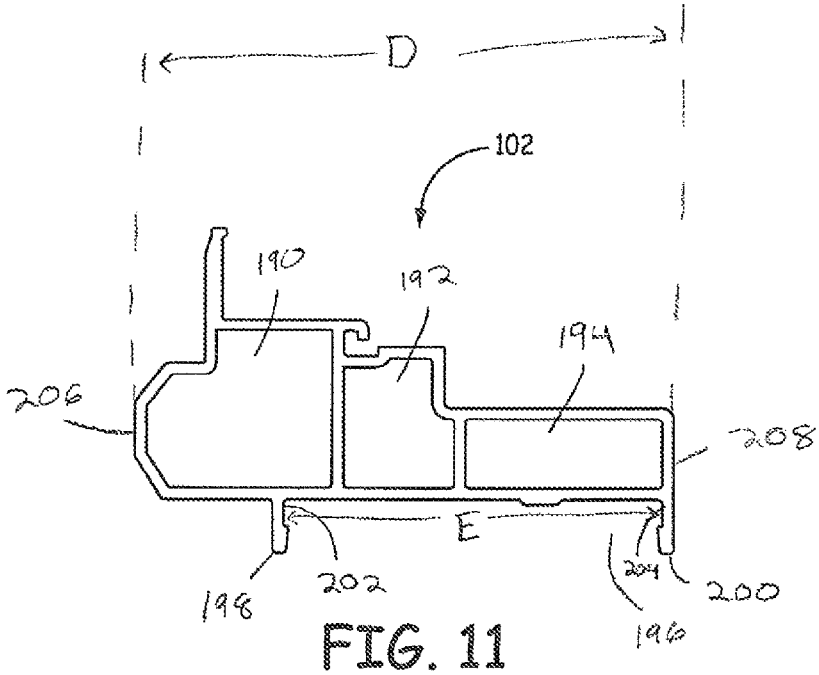
FIG. 11 depicts a cross-sectional view of another lineal member for a use in a frame of a picture window.
Figure 12:
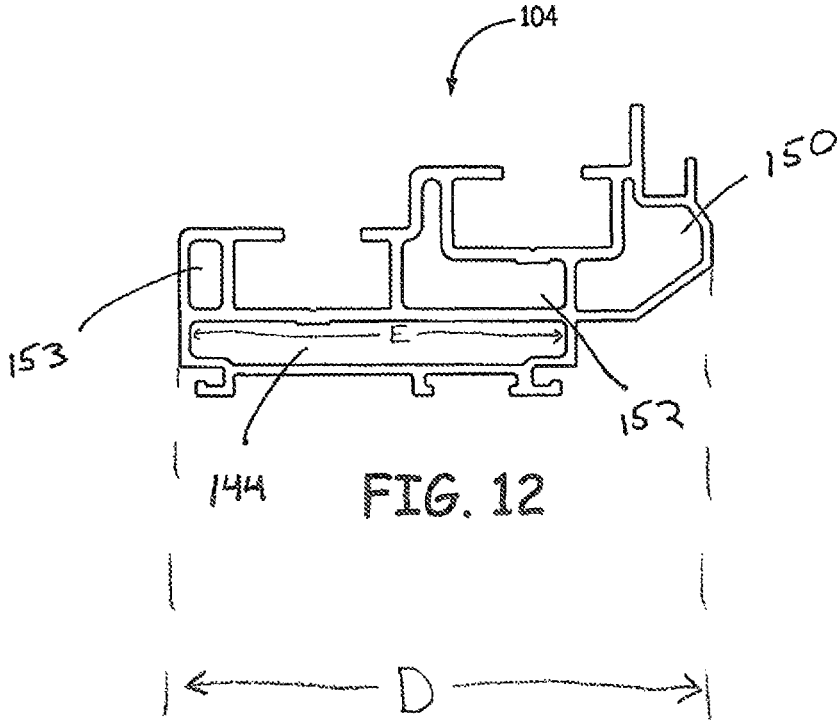
FIG. 12 depicts a cross-sectional view of another lineal member for use in a frame of a double hung window.

In some embodiments, the corner key cavity extends across at least about 60% of the depth of the frame member. In some embodiments, the corner key cavity extends across at least about 65% of the depth of the frame member. In some embodiments, the corner key cavity extends across at least about 67% of the depth of the frame member. In some embodiments, the corner key cavity extends across at least about 70% of the depth of the frame member. In some embodiments, the corner key cavity extends across at least about 72% of the depth of the frame member. In some embodiments, the corner key cavity extends across at least about 75% of the depth of the frame member. In the embodiment of FIGS. 3-5, the corner key extends across about 70% of the depth of the frame member. In the embodiment of FIG. 10, the corner key extends across about 67% of the depth of the frame member. In the embodiment of FIG. 11, the corner key extends across about 75% of the depth of the frame member. In the embodiment of FIG. 12, the corner key extends across about 71% of the depth of the frame member.

The assembled frame includes a first face and a second face. One of the faces is facing the viewer in FIG. 2. For example, the first face might be the exterior face of a building's window, while the second face is the interior face of a building's window. Referring to FIG. 3, the first side 46 of the frame member 10 will define part of the first face while the opposite second side 48 of the frame member 10 will define the second face.

In one embodiment, the lineal member 40 defines a first interior cavity 50 and a second interior cavity 52. The inclusion of multiple interior cavities 50, 52 increases the insulating properties of the frame 16. The interior cavities 50, 52 are longitudinal cavities that extend along the length of the frame member 10. In one embodiment, the lineal member 40 further defines a third interior cavity 53. The third interior cavity 53 is adjacent to one side 48, while the first interior cavity is adjacent to the other side 46. The second interior cavity 52 is positioned between the first and third interior cavities 50, 53.

In one embodiment, the lineal member defines at least one interior cavity and an open area for a corner key cavity. In one embodiment, the lineal member defines at least two interior cavities and an open area for a corner key cavity. In one embodiment, the lineal member defines at least three interior cavities and an open area for a corner key cavity. In one embodiment, the lineal member defines at least four interior cavities and an open area for a corner key cavity.

The lineal member 40 and the cap 42 each include attachment structures that interact with each other to cause a snap-fit attachment of the cap 42 to the lineal member 40. The lineal member 40 shown in FIGS. 4 and 5 includes an exterior surface 54 and first attachment structures 56, 57 defined by the exterior surface 54. In one embodiment, the first attachment structure includes two protrusions 56, 57 including nubs 58 near the ends of the protrusions 56, 57.

Mating attachment structures 60, 61 on the cap 42 are seen in FIGS. 6 and 7, and can also be referred to as protrusions 60, 61 defining nubs 62 at their ends. As seen in FIG. 3, the first and second attachment structures 56, 57, 60, 61 are configured to lock together when brought into contact. The second attachment structures 60, 61 of the cap fit within the first attachment structures 56, 57 extending from the lineal member 40. The first and second attachment structures are longitudinal features that extend along the length of the lineal member 40 and cap 42, respectively.

In the embodiments of the FIGS., the attachment structures are two longitudinal protrusions with nub structures which lock into an attached position with two similar longitudinal protrusions. In some embodiments, the attachment structure of the lineal member and the attachment structure of the cap are connected by a snap-fit. A snap-fit refers to a connection between parts where mating parts exert a cam action, flexing until one part slips past a raised lip on another part. Other types of attachment structures are present in some embodiments.

FIG. 8 is an exploded perspective view of the two parts that make up the corner key 14 in one embodiment. The outer portion 82 attaches to the inner portion 84 using interlocking mechanical structures to form the corner key 14. By making the corner key 14 in two parts, ease of manufacturing is increased. Also, the two-part corner key 14 allows adhesive to flow between the inner portion 84 and outer portion 82. The corner key 14 of FIGS. 8 and 9 has been found to be structurally solid after the adhesive is injected and has cured.

Figure 9:
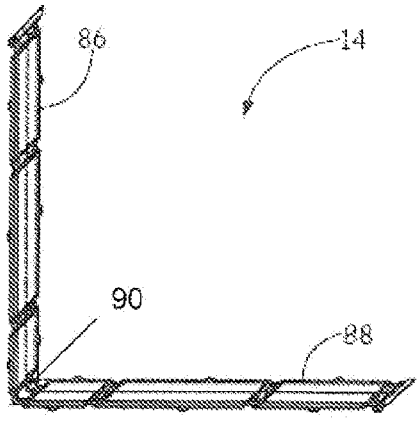
FIG. 9 is a side view of an assembled corner key of FIG. 8.

FIG. 9 is a side view of one embodiment of the corner key 14, which includes a first leg 86 and a second leg 88 forming a 90 degree angle with the first leg 86. In other embodiments, the angle is not 90 degrees. In other embodiments, the angle between the legs is adjustable. During the assembly of a frame, the first leg 86 is inserted into the end of a corner key cavity 44 of a first frame member, while the second leg 88 is inserted into the end of a corner key cavity 44 of another frame member 10. The corner key 14 is dimensioned and configured so that it will fit tightly within the corner key cavities 44. As a result, the two frame members 10 are joined.

The corner key joint 90 is the portion of the corner key 14 where the two legs 86, 88 or two halves are connected. In one embodiment, the joint 90 of the corner key 14 is flexible and acts as a hinge. As a result, the angle between the first and second legs 86, 88 can vary as needed depending on the frame shape.

The corner key 14 includes channels and recesses for routing and retaining adhesive that is injected into the corner area after the corner key 14 is positioned within adjacent frame members 10. The adhesive improves the structural integrity of the joint. The corner key 14 can be made from a wide variety of materials including nylon and crylonitrile-butadiene-styrene (ABS). In one embodiment, the corner key 14 is made from a non-metallic material.

The corner key 14 is configured to fit tightly within the corner key cavity 44. A measured amount of adhesive is injected into the joint once the corner key 14 is in place. The corner key cavity 44 and the corner key 14 are designed to encourage the adhesive to flow along each leg 86, 88, up against the ramp structures at the ends of the legs, through openings in the corner key and to spaces between inner and outer portions 82, 84. Bumps on the sides of the legs 86, 88 are designed to fit snuggly into the corner key cavity 44. In one embodiment, adhesive fills all the cracks and crevices in the joint area.

In one embodiment, the frame members are cut from lineal stock. In one embodiment, the frame members are formed to the lengths needed for constructing a frame assembly. In some embodiments, the frame members define a substantially hollow profile, though the interior cavity is divided into multiple cavities by interior walls in some embodiments.

In one embodiment, the frame members are made of pultruded fiberglass material. In another embodiment, the frame members are made of an extruded thermoplastic composite material. One example of a thermoplastic composite materials includes wood and polymer. A product of an extrusion process can be referred to as an extrudate. An extrudate has a uniform cross-section along its length. The frame members, lineal members and cap can be extrudates. In one embodiment, the frame members are made of vinyl.

Both pultrusion and extrusion processes form long parts with a uniform or constant cross-sections along their lengths which are also referred to as lineals. The lineal may be miter cut or cut in other ways at their ends to allow formation of an attractive joint with another lineal. The lineals may be cut to form the appearance of a mortise and tenon joint, while still using a corner key to join two frame members.

A few examples of profiles for window assemblies are illustrated herein, but it will be understood that many different further features may be present on the profiles. The invention disclosed and claimed herein is applicable to all such profiles.

FIGS. 10 and 11 depict cross-sectional views of different lineal members 100, 102 for a use in a frame of a casement window and a picture window, respectively. Like the lineal member 40 described with respect to FIGS. 4-5, the lineal members 100, 102 are configured for attachment to a cap. In one embodiment, each of the lineal members 100, 102 are configured for attachment to the same cap 42 which attaches to lineal member 40 in at least one embodiment. This reduces the number of different parts to be inventoried in manufacturing environment for frames. It also reduces the tooling expense and complexity of the manufacturing process. In addition, it is possible for a single corner key configuration to be used with multiple lineal members and frame types because the cap forming the corner key cavity is consistent across the various designs.

Lineal member 100 of FIG. 10 defines four interior cavities 170, 172, 174 and 176, in addition to defining a corner key cavity area 178. The corner key cavity area 178 is defined by two protrusions 180, 182 which serve as attachment structures for attaching to the cap 42. The depth D of the lineal member 100, which will also be the depth D of the resulting frame member including the cap 42, is shown in FIG. 10. The depth D of the lineal member 100 is measured from an outside surface 184 of a first side to an outside surface 186 of an opposite second side of the lineal member 100.

Lineal member 102 of FIG. 11 has three interior cavities 190, 192, 194 in addition to the corner key cavity area 196. The third interior cavity 194 is adjacent to one side 208, while the first interior cavity 190 is adjacent to the other side 206. The second interior cavity 192 is positioned between the first and third interior cavities 190, 194. The corner key cavity area 196 is defined by two protrusions 198, 200 which serve as attachment structures for attaching to the cap 42. The depth D of the lineal member 102, which is also the depth D of the resulting frame member including the cap 42, is shown in FIG. 11. The depth D of the lineal member 102 is measured from an outside surface 206 of a first side to an outside surface 208 of an opposite second side of the lineal member 102.

FIG. 12 shows a cross-sectional view of another embodiment of a frame member 104. Like lineal member 40, frame member 104 has three interior cavities 150, 152, 153 in addition to the corner key cavity 144. The third interior cavity 153 is adjacent to one side of the frame member, while the first interior cavity 150 is adjacent to the opposite of the frame member 104. The second interior cavity 152 is positioned between the first and third interior cavities 150, 153. The corner key cavity 144 is adjacent to the outer perimeter of the frame assembly. A frame assembly is formed by joining two or more of the frame members 104. The corner key cavity 144 extends across more than 60% of the depth of the frame member 104. The corner key cavity 144 is an integral part of the frame member profile. The frame member 104 is a unitary member. In one embodiment, the frame member 104 is formed by extruding a vinyl frame member 104.

In one embodiment, the frame member defines at least one interior cavity and a corner key cavity. In one embodiment, the frame member defines at least two interior cavities and a corner key cavity. In one embodiment, the frame member defines at least three interior cavities and a corner key cavity. Individual features or groups of features described herein with respect to the frame members or lineal members can also be combined with the lineal member 104.

There are many possible embodiments of methods of forming a frame assembly. In one embodiment, stock members such as the lineal members, the caps and/or frame assemblies are formed using pultrusion or extrusion so that each member has a uniform cross section over its length. In one embodiment, the members are formed by pultrusion of fiberglass.

In one embodiment, fairly long stock frame members and frame member components are formed by extrusion or pultrusion. The stock members can be formed in a standard length, such as sixteen foot lengths. In one embodiment, the frame members and frame member components are formed in the specific lengths that are needed for making frame assemblies.

In some embodiments, each frame member has a uniform cross section along its length. The cavities that are defined within the frame member will also have uniform cross sections across their lengths. Each frame member includes a first end and a second end. The first and second ends are angled ends in one embodiment. In some embodiments, the length of the frame member, lineal member or cap which extends between the angled ends has a uniform cross section.

In some embodiments, the frame members and frame member components are painted or laminated after formation. The paint coating or lamination covering can provide increased durability and aesthetic changes to the frame members.

In one embodiment, formation of a cap stock member can be followed by attaching a cap stock member to a lineal stock member to form a stock frame assembly. In other embodiments, the frame member is formed as a unitary structure without any need to attach a cap.

To construct a particular frame assembly from the stock frame members, the next step is to cut the stock frame members to the appropriate length with the appropriate miter cut at the ends. Another step is performance of routing operations such as forming adhesive injection holes, forming venting holes, forming window balance knock-outs and other routing operations as appropriate for the type of window. Hardware may also be added if appropriate.

Next, the frame members are brought together using a clamping system, with a corner key positioned at each corner. One leg or one half of the corner key is inserted into one end of a corner key cavity of a frame member. The other leg or half if the corner key is inserted into one end of a corner key of another frame member. Then, adhesive is injected into the joint areas. In one embodiment, each joint area includes two injection holes. Each injection hole is located near one of the legs of the corner key, on opposite sides of the joint 90 of the corner key and close to the joint of the corner key. In this embodiment, two venting holes are also provided close to the joint of the corner key.

In one embodiment, adhesive is used at the joints to enhance the structural integrity of the completed frame. In some embodiments, separate mechanical fasteners are used at the joints, either alone or in addition to adhesive. In one embodiment, the joint is secured with adhesive without the use of any separate mechanical fasteners. When the frame members are formed of hollow profile material as in the preferred embodiments, the ends of the lineals are sometimes mitered. In addition to or instead of adhesive and fasteners, the mitered ends can be joined securely together by other methods, for example, by sonic welding.

In some embodiments, vinyl frame members are used in combination with ultrasonic bonding of the frame members to form a corner joint. However, it may be desirable to touch-up the appearance of the vinyl if the vinyl laminate is modified by the ultrasonic welding. The use of corner keys and adhesive to form the joint reduces the likelihood of performing a touch-up step.

Design pressure (DP) is a metric of a window's strength and is measured in pounds per square foot (pst). Measurements techniques for DP are further described in ASTM E1300, titled "Standard Practice for Determining Load Resistance of Glass in Buildings." Windows according to the discussion herein can have a DP of at least 50 psf, a DP of at least 70 psf and DP of 90 psf in various embodiments.

Thermal performance of a window can be improved by using the frame described herein. The U-factor is a term that is used to quantify heat transfer. The units for U-factor are British thermal unit (Btu) per hour per square foot of area per degree Fahrenheit temperature difference. The computer programs Therm 5 and Window 5 are industry-standard computer tools used to simulate heat flow through the edge of the glass and window frame regions and through the center of glass. These programs also sum up the respective contribution of each component to determine the U-factor for the whole window. These computer programs were developed by the Lawrence Berkeley National Laboratory. Using these computer programs, testing was performed using the example of FIG. 3 where the frame is constructed of fiberglass, the corner key is constructed of ABS, and NovaGard 900-200 Corner Key Adhesive. AU-factor of 0.22 was achieved. An R5 rating is a sought after level of thermal insulation for a window. An R5 rating is achieved if a fixed unit has a U-factor of 0.20 or less. An R5 rating is achieved for an operating window unit where the U-factor is 0.22 or less. Embodiments of the frame assembly provided herein achieve an R5 rating.

An example of a system and method for forming a frame assembly has been described, but those of skill in the art will be aware of many options and alternatives to the equipment and method steps described that can be used.

Various embodiments are described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

I claim:

1. A structural frame member, comprising:

a body portion having an inner section defining a plurality of axially extending passages and an outer section defining a key passage area, wherein the key passage area defines an axially extending, transversely open channel, wherein the transversely open channel overlies at least a portion of one of the plurality of axially extending passages defined by the inner section; and a cap portion configured for engagement with the outer section of the body portion over the channel defined by the key passage area of the body portion, wherein, when the cap portion is engaged with the body portion over the channel defined by the key passage area, the cap portion and the channel defined by the key passage area of the body portion cooperate to define an enclosed key passage having an axially facing open end, wherein the key passage extends inwardly from the axially facing open end, wherein at least an end portion of the key passage adjacent the axially facing open end is unobstructed by the cap portion and configured to axially receive a portion of a corner key.

2. The structural frame member of claim 1, wherein the key passage area of the body portion is defined by a pair of spaced apart protrusions that extend from a wall forming a part of the body portion, wherein the protrusions in part define the channel, and wherein the cap portion is configured for engagement with the pair of spaced apart protrusions.

3. The structural frame number of claim 2, wherein the cap portion and the pair of spaced apart protrusions include snap-type engagement structure that secures the cap portion to the pair of spaced apart protrusions upon application of a transversely directed force to the cap portion.

4. The structural frame member of claim 2, wherein the outer and inner sections of the body portion are separated at least in part by the wall from which the spaced apart protrusions extend.

5. The structural frame member of claim 4, wherein the body portion defines a depth, and wherein the enclosed key passage defined by the key passage area of the body portion and the cap portion extends across a majority of the depth of the body portion.

6. The structural frame member of claim 2, wherein the enclosed key passage defined by the key passage area of the body portion and the cap portion overlies at least a pair of the axially extending passages defined by the body portion.

7. A structural frame assembly, comprising:

at least a pair of structural frame members, wherein each frame member comprises: a body portion having an inner section defining a plurality of axially extending passages and an outer section defining a key passage area, wherein the key passage area defines an axially extending, transversely open channel, wherein the transversely open channel overlies at least a portion of one of the plurality of axially extending passages defined by the inner section; and a cap portion engaged with the outer section of the body portion over the channel defined by the key passage area, wherein the cap portion and the channel defined by the key passage area of the body portion cooperate to define an enclosed key passage having an axially facing open end, wherein the key passage extends inwardly from the axially facing open end, wherein at least an end portion of the key passage adjacent the axially facing open end is unobstructed by the cap portion; wherein the axially facing open ends of the key passages of the pair of structural frame members face each other; and a corner key extending through the facing open ends of the structural frame members and into the key passages of the structural frame members, wherein engagement of the corner key within the key passages of the pair of structural frame members secures the pair of structural frame members together.

8. The structural frame assembly of claim 7, wherein the structural frame members comprise window frame members.

9. The structural frame assembly of claim 8, wherein the key passage area of the body portion of each structural frame member is defined by a pair of spaced apart protrusions that extend from a wall forming a part of the body portion of the structural frame member, wherein the protrusions in part define the channel, and wherein the cap portion is configured for engagement with the pair of spaced apart protrusions.

10. The structural frame assembly of claim 9, wherein the cap portion and the pair of spaced apart protrusions include snap-type engagement structure that secures the cap portion to the pair of spaced apart protrusions upon application of a transversely directed force to the cap portion.

11. The structural frame assembly of claim 9, wherein the outer and inner sections of the body portion of each structural frame member are separated at least in part by the wall from which the spaced apart protrusions extend.

12. The structural frame assembly of claim 11, wherein the body portion of each structural frame member defines a depth, and wherein the enclosed key passage defined by the key passage area of the body portion and the cap portion of each structural frame member extends across a majority of the depth of the body portion.

13. The structural frame assembly of claim 9, wherein the enclosed key passage defined by the key passage area of the body portion of each structural frame member and the associated cap portion overlie at least a pair of the axially extending passages defined by the body portion of each structural frame member.

14. The structural frame assembly of claim 7, wherein a plurality of structural frame members and corner keys are secured together to define an enclosed frame assembly.

15. A method of assembling a structural frame member, comprising the acts of:

providing a body portion having an outer section defining a plurality of axially extending passages and an inner section defining a key passage area, wherein the key passage area defines an axially extending, transversely open channel, wherein the transversely open channel overlies at least a portion of one of the plurality of axially extending passages defined by the inner section; and engaging a cap portion with the key passage area over the channel defined by the key passage area, wherein, when the cap portion is engaged with the body portion over the channel defined by the key passage area, the cap portion and the channel defined by the key passage area of the body portion cooperate to define an enclosed key passage having an axially facing open end, wherein the key passage extends inwardly from the axially facing open end, wherein at least an end portion of the key passage adjacent the axially facing open end is unobstructed by the cap portion and configured to axially receive a portion of a corner key.

16. The method of claim 15, wherein the key passage area is defined at least in part by a pair of protrusions on the body portion, wherein the protrusions in part define the channel, and wherein the act of engaging the cap portion with the key passage area is carried out by snap fitting the cap portion and the pair of protrusions together.

17. The method of claim 15, further comprising the act of providing a plurality of the structural frame members, wherein the cap portion and the key passage area of the body portion of each structural frame member cooperate to define an enclosed key passage, wherein the axially facing open ends of the key passages of each pair of the frame members face each other;

positioning the ends of the pair frame members adjacent each other; and engaging a corner key with the corner key passages of the pair of structural frame members, wherein the corner key extends through the axially facing open ends of the key passages of the pair of structural frame members and into the key passages of the structural frame members, wherein engagement of the corner key within the key passages of each adjacent pair of structural frame members secures the structural frame members together.

18. The method of claim 17, further comprising the act of placing adhesive in the corner key passages of the pair of structural frame members, wherein the adhesive interacts with the corner key and the structural frame members to assist in securing the pair of structural frame members together.

* * * * *

UNITED STATES PATENT AND TRADEMARK OFFICE

CERTIFICATE OF CORRECTION

PATENT NO. : 8,511,011 B2
APPLICATION NO. : 13/604037
DATED : August 20, 2013
INVENTOR(S) : Brian A. Emanuel It is certified that error appears in the above-identified patent and that said Letters Patent is hereby corrected as shown below:

IN THE CLAIMS:

Column 9, in Claim 3, line 25, delete “number” and substitute therefore -- member --.

Signed and Sealed this
Eighth Day of October, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,511,011 B2
APPLICATION NO. : 13/604037
DATED : August 20, 2013
INVENTOR(S) : Brian A. Emanuel and Gerald Beranek It is certified that error appears in the above-identified patent and that said Letters Patent is hereby corrected as shown below:

On the title page item (75) Inventor: Please add -- Gerald Beranek -- as an inventor.

Signed and Sealed this
Ninth Day of February, 2016

Michelle K. Lee

Michelle K. Lee
*Director of the United States Patent and Trademark Office*